United States Patent [19]

Nakanishi et al.

[11] Patent Number: 4,990,957

[45] Date of Patent: Feb. 5, 1991

[54] AUTOMATIC EXPOSURE DEVICE

[75] Inventors: Yasushi Nakanishi; Atsushi Narukawa, both of Yamatokooriyama; Masakiyo Okuda, Kashiwara; Masanori Mori, Mie; Yukio Nakai, Nara, all of Japan

[73] Assignee: Sharp Kabushiki Kaisha, Osaka, Japan

[21] Appl. No.: 359,289

[22] Filed: May 31, 1989

[30] Foreign Application Priority Data

May 31, 1988 [JP] Japan ..... 63-135317

[51] Int. Cl.[5] ..... G03G 15/04

[52] U.S. Cl. ..... 355/228; 355/68; 355/69; 355/214

[58] Field of Search ..... 355/68, 69, 214, 228, 355/229, 203, 204, 206, 209, 230, 232, 241, 242

[56] References Cited

U.S. PATENT DOCUMENTS

| | | | |
|---|---|---|---|
| 4,124,294 | 11/1978 | Nakamura . | |
| 4,674,863 | 6/1987 | Tomosada et al. | 355/214 |
| 4,796,060 | 1/1989 | Mizude | 355/68 |
| 4,831,418 | 5/1989 | Ito et al. | 355/69 |
| 4,910,554 | 3/1990 | Noda | 355/208 |

*Primary Examiner*—A. T. Grimley
*Assistant Examiner*—Thu Anh Dang

[57] ABSTRACT

An automatic exposure control device for use in a copying machine in which a light source for illuminating the light to an original document is controlled based on the signal representing the light amount of the original document sensed by a light senses. There are two kinds of HIGH level limiter for limiting the upper limit of the power supplied to the light source. The HIGH level limiters are selected depending on whether the amount of light of the light source has been raised sufficiently or not, whereby over exposure copy or foggy copy can be prevented.

9 Claims, 3 Drawing Sheets

AUTOMATIC EXPOSURE DEVICE

BACKGROUND OF THE INVENTION

1. Field of the Invention

The present invention relates to an automatic exposure device for use in an image: forming device such as an electronic copying machine.

2. Description of the Prior Art

A conventional automatic exposure device for use in a copying machine is arranged so as to detect the amount of light reflected from an original document to be copied by a light sensor and to control the power of a light source for illuminating the original document based on the light signal obtained by the light sensor. In case where detection indicates that the original document is dark, power supplied to the light source is increased, alternatively, when detection indicates that the original document is bright, the power supplied to the light source is decreased, in order to assure an optimum exposure to the original document corresponding to the density of the picture of the original document to prevent a fogging of the copied picture. In the automatic exposure control device mentioned above, although the power to the light source is increased if it is detected that the original document is dark, the light source emits excessive light without an upper power limit. The problem that results with the aforementioned process is that if an original with slight lines near very dark characters is copied, the lines and/or characters disappear in the copied picture. To solve this problem, therefore, an upper limit of the supplied power level for the light source is set. In the conventional automatic exposure control devices, the upper limit of the power level supplied to the light source is fixed.

However, there may occur a case that the starting up time of the light value emitted from the light source differs greatly depending on the kinds of the light source and the temperature of the atmosphere of the light source. For example, when a fluorescent lamp is used as the light source, the starting up time of the light from the lamp is delayed greatly if the atmosphere temperature is low compared with the lamp driven in a normal room temperature and there may occur such a case that the amount of the light reflected from the original document can not reach a sufficient light level even if a full power is supplied to the lamp. If the power to the light source is limited to the upper limiting level under the condition mentioned above, the amount of the light reflected from the original document becomes insufficient, resulting in making a copy that is foggy.

SUMMARY OF THE INVENTION

An essential object of the present invention is to provide an automatic exposure control device which is able to prevent lack of light for exposure even if the amount of light from the light source is starting up by changing the upper light limit level corresponding to the degree of the starting up state.

According to the automatic exposure control device of the present invention, the degree of the starting up of the light from a light source is detected based on the output value of the light sensor at a predetermined period after application of the power to the light source. The detection of the degree of the starting of the light source can be conducted in such a manner that the light source is turned on with full power before a portion lighted by the light from the light source reaches the leading end of the original document, and the the degree of the starting light is detected based on the output level of the sensor just before the lighted portion comes to the end of the original document. If the amount of the light during the starting up period is not sufficient, the output level of the sensor is low, on the other hand, if the light amount of the light has fully starting up, the output level of the sensor is high. With the detection of the starting up condition of the light, the level of the upper limit of the power supplied to the light source is changed corresponding to the output level of the sensor. The lower the degree of the starting up of the light source, the higher the upper power limit is set. If the degree of starting up of the light source is sufficient, the level of the upper power limit is set relatively low. By the arrangement mentioned above, when the degree of the starting up of the light amount of the light source is low, it becomes possible to supply a sufficient power to the light source. If the degree of the starting up of the light amount of the light source is sufficient, the power to the light source is limited so that an excessive power supply can be prevented.

DETAILED DESCRIPTION OF THE PREFERRED EMBODIMENT

Figure 1:
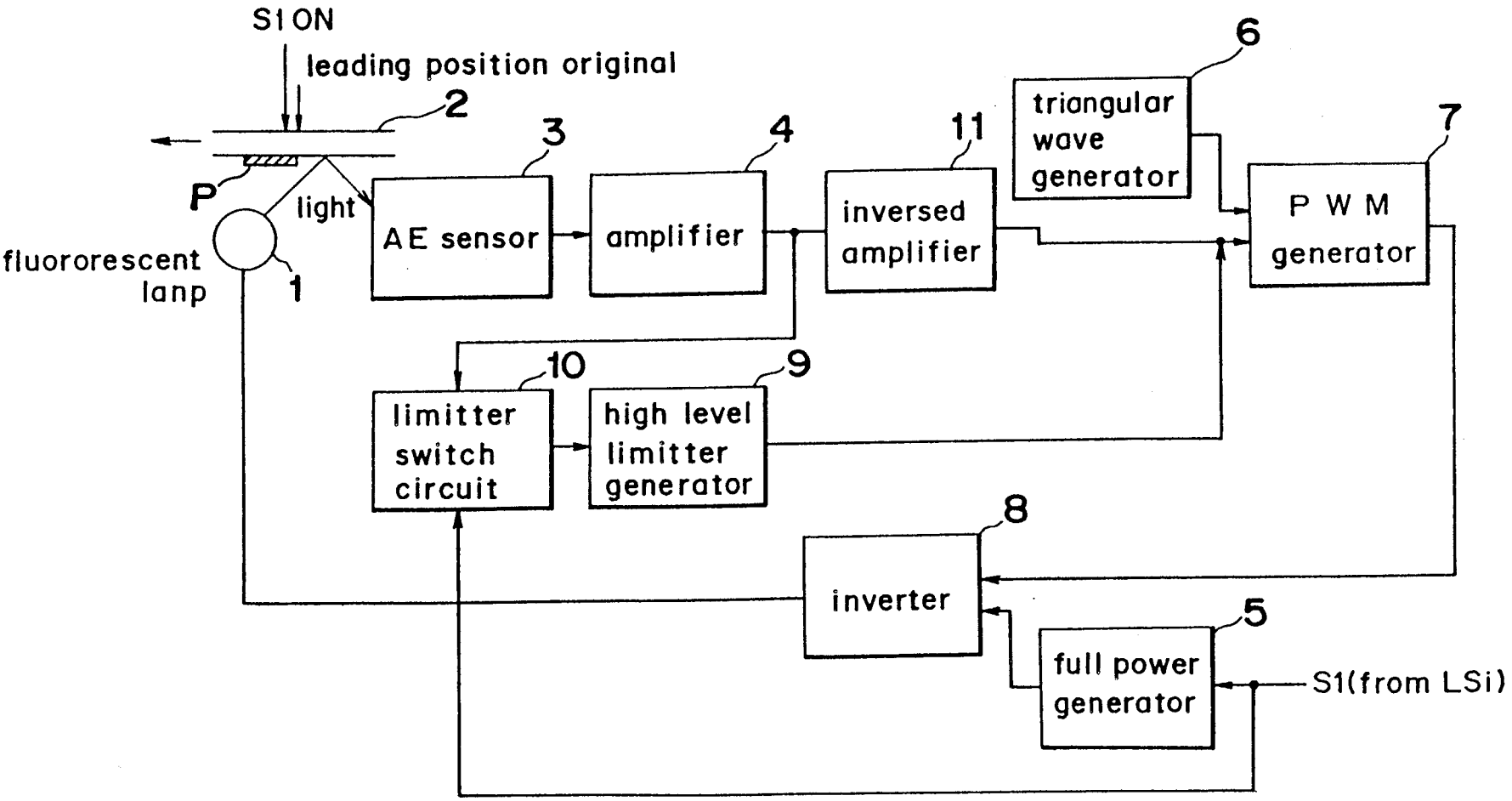
FIG. 1 is a block diagram showing an embodiment of the automatic exposure control device according to the present invention.
Figure 2:
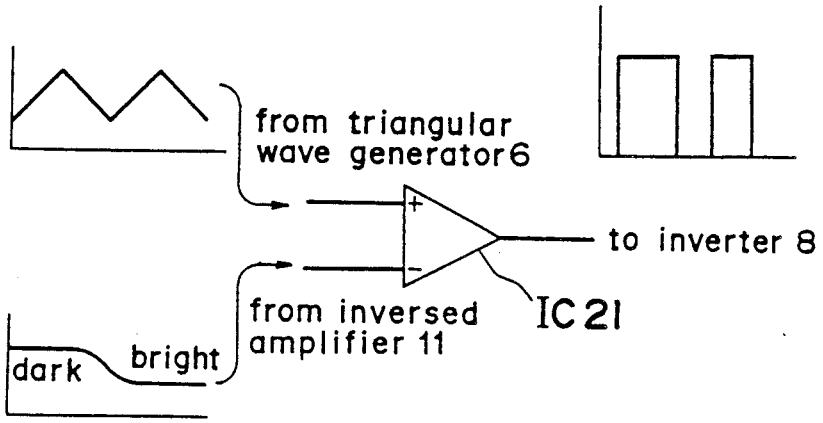
FIG. 2 is a schematic diagram showing an operation of a PWM generation circuit used in the device shown in FIG. 1.

In FIG. 1, fluorescent lamp 1 used for illuminating an original document platform 2 of a copying machine. It is noted that in general the fluorescent lamps have a property that the rising of the amount of light emitted from the lamp is delayed greatly in low temperature compared with the starting time of the light amount in normal temperature. The light emitted from the fluorescent lamp 1 and projected to the original platform 2 is detected by an automatic exposure sensor 3 (referred to as AE sensor hereinafter) in terms of the light amount and the voltage proportional to the amount of the received light is amplified to a suitable level by an amplifier 4. The output of the amplifier 4 is supplied to a inverted amplifier 11 and a limiter switching circuit 10. The output signal inverted and amplified by the inverted amplifier 11 is supplied to a PWM generator 7 in which pulse width modulated (PWM) signal is generated by comparison with the signal from the inverted amplifier with a triangular signal fed from a triangular wave generator 6. FIG. 2 shows a specific operation of the PWM generator 7. In the arrangement shown in FIG. 2, the circuit comprising IC 21 formed by a comparator having its + input terminal applied the triangular wave from the triangular wave generator 6 and − input terminal applied with the output signal of the inverted amplifier 11. The level of the output signal of the inverted amplifier 11 is in inverse proportional to the amount of light incident to the AE sensor 2 as shown. That is, the greater the reflection light amount, the lower (the brighter) the level of the AE sensor, on the other hand, the smaller the reflection light amount, the higher the level of the AE sensor (the darker). The IC 21 compares the output level of the inverted amplifier 11 with the triangular wave signal and generates the PWM wave signals from the output terminal. The PWM wave signals are fed to an inverter 8 in which control the high frequency drive time of the fluorescent lamp 1 corresponding to the pulse width. That is, if the amount of the reflection light from the original document is low, the on period of the inverter 8 is made long so as to increase the power supplied to the fluorescent lamp 1 thereby resulting in making the fluorescent lamp 1 bright. On the other hand, the amount of the reflection light from the original document is high, the on period of the inverter 8 is decreased to make the fluorescent lamp 1 dark.

A full power generator 5 is connected to the input terminal of the inverter 8, the full power generator 5 supplies a full power supply signal to the inverter 8 in a period beginning from pressing of a copy button (not shown) to reception of a signal S1 from the LSI of the control unit (not shown). The inverter 8 supplies the full power to the fluorescent lamp 1 so long as the inverter receives the signal S1 independent of the PWM wave signal. It is noted that the signal S1 raises just before the period of time during which, after the copy button is pressed, the position of the emitting light by the fluorescent lamp 1 reaches the leading end of the original document (the time defined by the copy magnification) lapses.

When the signal S1 raises, the output from the full power generator 5 disappears and the inverter 8 controls the light of the fluorescent lamp 1 based on the PWM wave signal. As shown in FIG. 1, there is located a white reflection region made of a white plate in front of the original leading end position on the original platform 2 and the AE sensor 3 receives the reflection light from the white reflection region p until the signal S1 has fully raised up. As mentioned below, the output of the AE sensor 3 when the signal S1 has started up relates to the degree of the light amount of the starting up of the light of the fluorescent lamp 1, whereby the upper limit level of the power supplied to the fluorescent lamp 1 is set based on the output of the AE sensor 3.

The circuit arrangement for setting the upper limit of the power supplied to the fluorescent lamp 1 is formed by a limiter switching circuit 10 and a HIGH level limiter generator 9.

The limiter switching circuit 10 receives the output of the amplifier 4 and the signal S1 to determine the upper limit level (deferred to as HIGH level limiter) of the power supplied to the fluorescent lamp 1. The HIGH level limiter generator 9 generates the HIGH level limiter upon receipt of the output of the limiter switching circuit 10 and inputs the HIGH level limiter in the input terminal of the PWM generator 7. The output of the inverted amplifier 11 and the HIGH level limiter are fed to the same input terminal of the PWM generator 7, therefore, the upper level of the output of the inverted amplifier 11 is limited by the HIGH level limiter.

Figure 3:
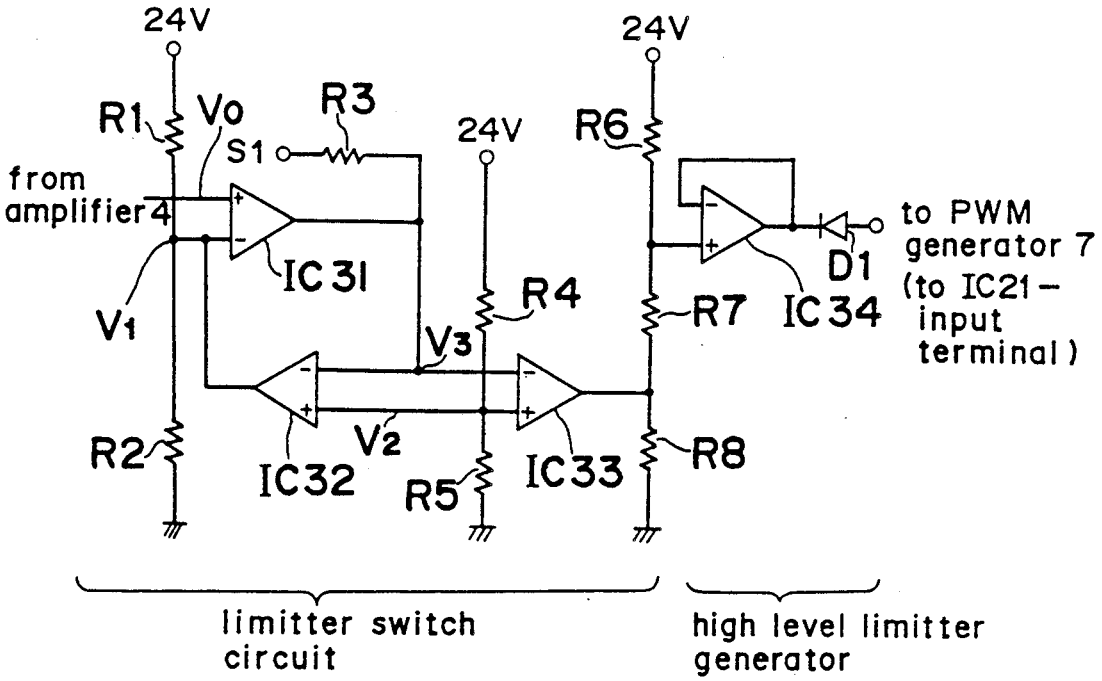
FIG. 3 is a schematic diagram showing a detailed circuit of a limiter switching circuit and a high level limiter switching circuit.

FIG. 3 shows a specific diagram of the limiter switching circuit 10 and the HIGH level limiter generator 9.

The limiter switching circuit 10 comprises IC 31 to IC 33 and the HIGH level limiter generator 9 comprises dividing resistors R6 to R8 and IC 34.

The output of the amplifier 4 is fed to the + input terminal of the IC3 as the voltage $V_0$. A standard voltage $V_1$ which is divided by the resistors R1 and R2 is applied to the − input terminal of the IC 31. The standard voltage V1 is set to a level for discriminating whether or not the amount of the reflection light is raised sufficiently at the time of the raising of the signal S1, showing that the amount of the reflection light has fully raised with V0>V1, and the amount of the reflection light has not raised with V0>V1. The IC 31 generates "H" (high level) for V0>V1 and generates "L" (low level) for V0<V1. The IC32 is used for locking the output of the IC 31. Since the signal S1 is input to the − input terminal of the IC 32, at the start point of the automatic exposure control operation (AE operation) by the application of the signal S1, in other word, when the output of the IC 31 is "H" at the period when the illuminating point of the fluorescent lamp 1 reaches just before the leading end of the original document, the output of the IC 32 becomes "L", whereby "H" output of the IC 31 is maintained. If the output of the IC 31 is "L" at the time of application of the signal S1, since the − input terminal of the IC 32 becomes "L", and the output of the IC 32 becomes "H", whereby the output "L" of the IC 31 is maintained. In the latter case, when the signal S1 rises, the voltage V0 corresponding to the light reflected from the white reflection region P disposed just before the leading end of the original document is lower than the standard voltage V1, the light amount reflected from the white region of the original document during the AE operation is lower than the amount of the light reflected from the white reflection region P, the relation V0<V1 can be maintained, whereby the output of the IC 31 is maintained at "L".

The IC 33 generates the signal "L" when the output of the IC 31 is "H" corresponding to the output of the IC 31 which is fixed after the signal S1 is raised, and when the output of the IC 31 is "L", the IC 33 generates the signal "H".

The IC 34 composing a part of the HIGH level limiter circuit 9 is formed by a voltage follower to output the input signal applied to the + input terminal directly to the output terminal. When the output of the IC 33 is "H", the IC 34 generates the voltage $V_{L1}$ determined by the dividing ratio determined by the resistors R6, R7 and R8, on the other hand, when the output of the IC 33 is "L", the IC 34 generates the voltage $V_{L2}$ decided by the dividing ratio determined by the resistors R6 and R7. It is noted that $V_{L1}$ is greater than $V_{L2}$ that is $V_{L1}>V_{L2}$.

Summing up the above operations, if the amount of the light of the fluorescent lamp has sufficiently started up, the operation is described as V0>V1 results in V3>V3 and V3>V2 results in the output of the IC 33 to be "L", which results in $V_{L2}$.

If the amount of the light of the fluorescent lamp has not fully started up, the operation is described as V0<V1 results in V3<V2 and V3<V2 results in the output of the IC 33 to be "H", which results in $V_{L1}$, wherein $V_{V1}>V_{L2}$.

In the present embodiment, there are set two steps of the HIGH level limiters based on the output of the AE sensor 3 upon turning on of the fluorescent lamp 1 and upon raising of the signal S1. The voltage of the HIGH level limiter is fed to the − input terminal of the IC 21 of the PWM generator 7 with the output signal of the inverted amplifier 11. Therefore, the signal of the inverted amplifier 11 is so controlled not as to be higher than the voltage $V_{L2}$ under such a condition that the light amount of the fluorescent lamp 1 has sufficiently started up, on the other hand, the signal of the inverted amplifier 11 is so controlled not as to be higher than the voltage $V_{L1}$ if the light amount of the fluorescent has not sufficiently started up.

In other word, if the light amount of the fluorescent lamp 1 has not sufficiently started up or the fluorescent lamp is dark, the HIGH level limiter is set to the brighter level, on the other hand if the light amount of the fluorescent lamp 1 has sufficiently started up, the HIGH level level limiter is set to the darker level. By the control mentioned above, it can be avoided that the HIGH level limiter is set excessively low in case where the light amount of the fluorescent lamp has not sufficiently started up, on the other hand, it can be avoided that the HIGH level limiter is set excessively high in case where the light amount of the fluorescent lamp has sufficiently started up. Accordingly, even if the amount of light of the fluorescent lamp has not sufficiently started, there can be obtained a copy without fog. On the other hand, even if the light amount of the fluorescent lamp 1 has sufficiently started, there can be obtained a good copy preventing from making such a copy that characters and lines around a heavily dark portion are made thin or disappear.

Figure 4:
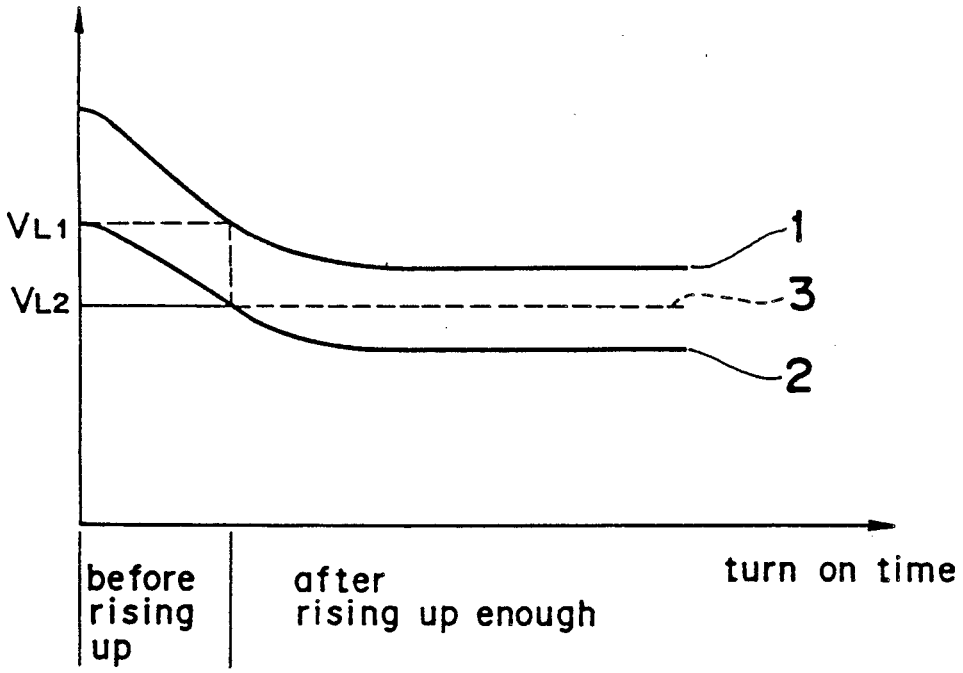
FIG. 4 is graphs showing change of the upper limit of the power supply.

FIG. 4 is a graphs showing optimum voltage range at the − input terminal of the IC 21. The level (1) shows a critical boundary for preventing from making such a copy that the characters or lines near the heavily dark portion of the original document becomes thin or disappear. The level (2) shows a critical boundary for preventing from making fogged copy. The dotted line (3) shows the HIGH level limiters $V_{L1}$ and $V_{L2}$. In the region A in which the light amount of the fluorescent lamp has not sufficiently started, the higher HIGH level limiter $V_{L1}$ is set. If the lower HIGH level limiter $V_{L2}$ is set in the range A, the upper power supply limit is set lower than the critical boundary line (2), and therefore, the copy may be fogged. In the region B, in which the amount of light of the fluorescent lamp 1 has sufficiently started, the HIGH level limiter $V_{L2}$ of lower level is set. If the HIGH level limiter $V_{L1}$ of the higher level is set, the upper power supply limit exceeds the critical boundary (1) which makes the characters near the heavily dark portion of the original document becomes thin.

In the embodiment mentioned above, a full power is supplied to the fluorescent lamp 1 before the signal S1 starts up so as to accelerate start up of the lamp to the sufficient light amount.

In the embodiment mentioned above, there are two steps of the HIGH level limiters, there may be provided more than two steps of the HIGH limiters.

What is claimed is:

1. An automatic exposure control device operatively connected to a light source driven by an electric power supply, comprising:

means for illuminating the light source so as to emit light to an original document, which will reflect the light;

light sensing means for sensing the light reflected from the original document;

control means for controlling the power supply to the light source based ion a signal representing an amount of light reflected from the original document sensed by the light sensing means;

light start up determining means for determining the amount of light emitted from the light source based on a signal of the light sensing means; and upper limit setting means operatively associated with the power supply for setting an upper limit level of power supplied to the light source based on the output of the light start up determining means.

2. The device according to claim 1, wherein the electrical power supply is capable of providing full power for fully illuminating the light source; and means for supplying full power to the light source until an upper limit of power is set.

3. The device according to claim 1, further comprising a light reflecting member for reflecting the light from the light source to the light sensing means, said light reflector member being located at a leading position of an original platform.

4. The device according to claim 1, wherein said upper limit setting means comprises an electronic circuit for controlling an upper limit value, said electronic circuit being composed of first, second and third operational amplifiers operatively connected so that a non-inverted input of the first operational amplifier is connected to receive a signal of said light sending means with the output thereof connected to an upper limit setting voltage source and inverted input terminals of the second and third operational amplifiers and the output of the second operational amplifier are operably connected to the inverted input of the first operational amplifier operably connected to an input terminal a pulse generator which generate pulses to control the power supplied to said light source.

5. An automatic exposure control device operatively connected to a light source driven by an electric power supply comprising:

means for illuminating the light source so as to emit light to an original document which will reflect the light;

light sensing means for sensing the light reflected from the original document;

control means for controlling the power supply to the light source based on a signal representing an amount of light reflected from the original document sensed by the light sensing means;

light start up determining means for determining an amount of light emitted from the light source based on a signal for the light sensing means; and variable upper limit setting means operatively associated with the power supply for variably setting an upper limit level of power supplied to the light source based on the output of the light start up determining means.

6. The device according to claim 5, wherein the electrical power supply is capable of providing full power for fully illuminating the light source; and means for supplying full power to the light source until an upper limit of power is set.

7. The device according to claim 5, further comprising a light reflecting member for reflecting the light from the light source to the light sensing means, said light reflector member being located at a leading position of an original platform.

8. The device according to claim 5, wherein said upper limit setting means comprises an electronic circuit for controlling an upper limit value, said electronic circuit being composed of first, second and third operational amplifiers operatively connected so that a non-inverted input of the first operational amplifier is connected to receive signals of said light sensing means with the output thereof connected to an upper limit setting voltage source and inverted input terminals of the second and third operational amplifiers and the output of the second operational amplifier are operably connected to the inverted input of the first operational amplifier operably connected to an input terminal a pulse generator which generate pulses to control the power supplied to said light source.

9. An exposure control device for use with an original document copying apparatus that includes a light sensor and uses a light source driven by a power supply comprising:

light start up determining means for determining an amount of light emitted from he light source during start up based on a signal of the light sensor;

an upper limit setting means operatively associated with the power supply for setting an upper limit level of power supplied to the light source based on the output of the light start up determining means;

said light start up determining means and upper limit setting means functioning to supply sufficient power to the light source to provide a necessary amount of light for exposure of a document for copying.

* * * * *